US010126092B2

(12) United States Patent
Ozanne

(10) Patent No.: US 10,126,092 B2
(45) Date of Patent: Nov. 13, 2018

(54) COCKING ROPE WITH ANGLED HOOKS

(71) Applicant: MCP IP, LLC, Sparta, WI (US)

(72) Inventor: Jeffrey A. Ozanne, Sparta, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 15/601,877

(22) Filed: May 22, 2017

(65) Prior Publication Data

US 2017/0343313 A1 Nov. 30, 2017

Related U.S. Application Data

(60) Provisional application No. 62/340,991, filed on May 24, 2016.

(51) Int. Cl.
*F41B 5/12* (2006.01)
*F41B 5/14* (2006.01)

(52) U.S. Cl.
CPC ..... *F41B 5/1469* (2013.01); *F41B 5/123* (2013.01); *F41B 5/12* (2013.01); *F41B 5/14* (2013.01); *F41B 5/1442* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 3,538,901 | A | 11/1970 | Switack | |
| 4,603,676 | A | 8/1986 | Luoma | |
| 4,662,345 | A | 5/1987 | Stephens | |
| 4,942,861 | A | 7/1990 | Bozek | |
| 5,220,906 | A | 6/1993 | Choma | |
| 5,243,956 | A | 9/1993 | Luehring | |
| 5,823,172 | A | 10/1998 | Suggitt | |
| 6,286,496 | B1 | 9/2001 | Bednar | |
| 6,874,491 | B2 | 4/2005 | Bednar | |
| 6,913,007 | B2 | 7/2005 | Bednar | |
| 7,100,590 | B2 | 9/2006 | Chang | |
| 7,624,725 | B1 | 12/2009 | Choma | |
| 8,443,790 | B2 | 5/2013 | Pestrue | |
| 8,453,631 | B1 | 6/2013 | Kronengold | |
| 8,578,917 | B2 | 11/2013 | Bednar | |
| 9,022,013 | B2 | 5/2015 | Trpkovski | |
| 9,341,434 | B2 | 5/2016 | McPherson et al. | |
| 9,404,706 | B2 | 8/2016 | Khoshnood | |
| 9,599,425 | B2 | 3/2017 | Barnett | |
| 9,797,676 | B2 * | 10/2017 | Houle | F41B 5/12 |
| 2006/0086346 | A1 | 4/2006 | Middleton | |
| 2010/0170488 | A1 | 7/2010 | Rasor | |
| 2011/0232619 | A1 | 9/2011 | Bednar | |
| 2013/0298890 | A1 | 11/2013 | Bednar | |
| 2013/0305579 | A1 | 11/2013 | Ward et al. | |
| 2014/0069403 | A1 | 3/2014 | Simonds | |

* cited by examiner

*Primary Examiner* — John Ricci

(57) ABSTRACT

In some embodiments, a crossbow cocking device comprises a rope and a hook engaged with the rope. The hook defines a longitudinal axis and comprises a valley, a surface of the valley oriented at a non-orthogonal angle to the longitudinal axis.

18 Claims, 7 Drawing Sheets

COCKING ROPE WITH ANGLED HOOKS

CROSS-REFERENCE TO RELATED APPLICATIONS

This application claims the benefit of U.S. Patent Application No. 62/340,991, filed May 24, 2016, the entire disclosure of which is hereby incorporated herein by reference.

BACKGROUND OF THE INVENTION

This invention relates generally to crossbows and more specifically to drawing devices such as a cocking rope suitable for drawing and cocking a crossbow.

Crossbow cocking ropes are known in the art, for example as disclosed in US2014/0069403, the entire content of which is hereby incorporated herein by reference.

Traditional crossbow cocking ropes generally have hooks that are attached to the bowstring and used to draw the crossbow. Hooks are shaped to engage the crossbow string in the brace condition, wherein the string is oriented orthogonal to the shooting axis.

As the crossbow is drawn, the string angle changes. Hooks that are designed to engage a string oriented orthogonal to the shooting axis can have difficulty engaging a string oriented non-orthogonally, for example when the crossbow is cocked.

There remains a need for novel crossbow cocking rope configurations.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a crossbow cocking device comprises a rope and a hook engaged with the rope. The hook defines a longitudinal axis and comprises a valley, a surface of the valley oriented at a non-orthogonal angle to the longitudinal axis.

In some embodiments, a crossbow cocking device is arranged to engage a crossbow string. The device comprises a rope and a hook engaged with the rope. The hook comprises a string cavity and an opening into the string cavity. The string cavity is arranged to receive the crossbow string. A distance across the opening is less than a parallel distance across the string cavity.

In some embodiments, a crossbow cocking device comprises a rope and a hook engaged with the rope. The hook comprises a rope cavity and the rope extends through the rope cavity. The rope is frictionally engaged with the rope cavity such that a force of gravity does not cause the hook to move along a length of the rope.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
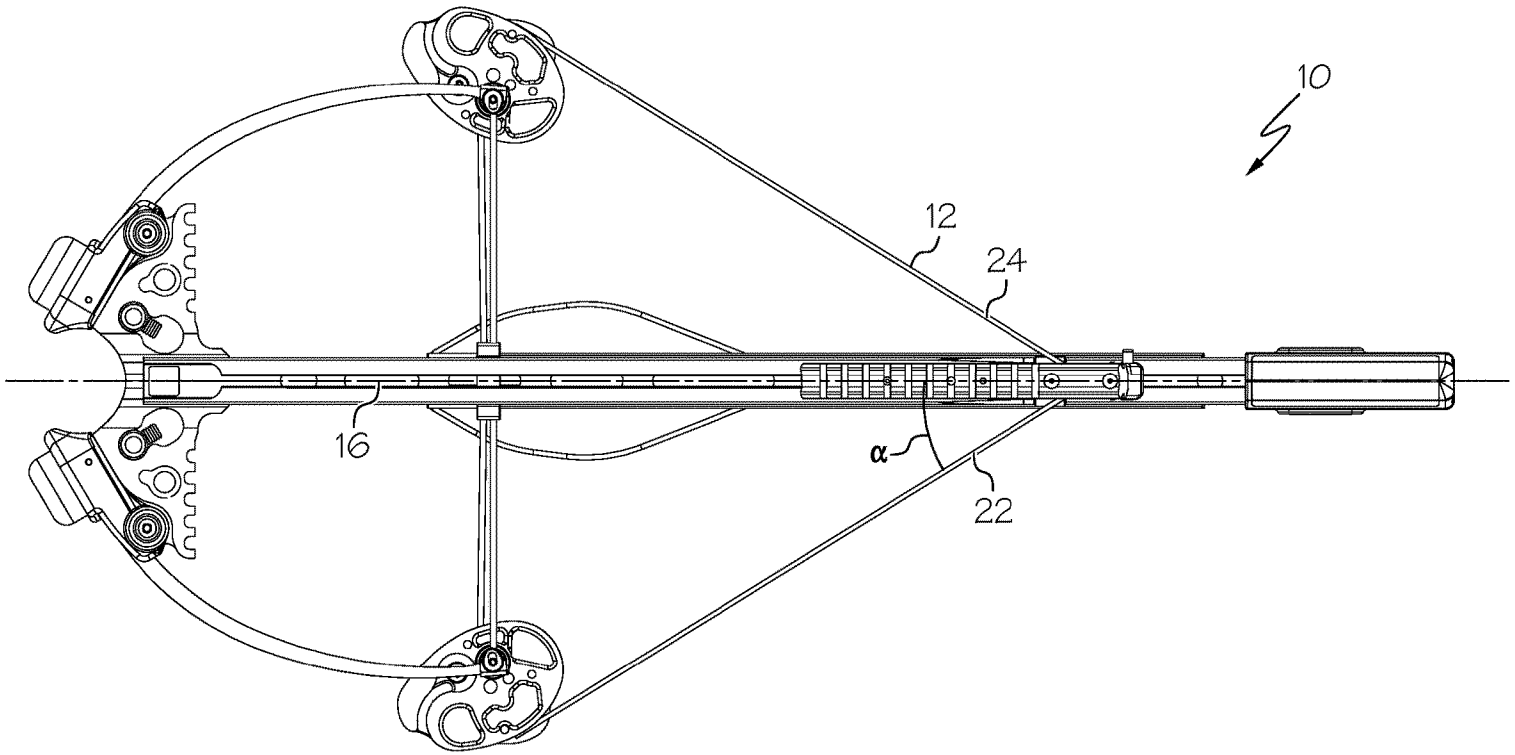
FIG. 1 shows a crossbow in a drawn condition.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a crossbow 10 in a drawn orientation, wherein the string 12 is drawn. The crossbow 10 defines a shooting axis 16.

When the crossbow 10 is in a brace condition, the string 12 is typically oriented perpendicular to the shooting axis 16. The hooks for existing crossbow cocking devices are generally configured to engage the string 12 when it is perpendicular to the shooting axis 16, for example as disclosed in US 2014/0069403.

In the drawn condition as shown in FIG. 1, the string 12 includes a first portion 22 and a second portion 24, which are located on opposite sides of the shooting axis 16. Each portion 22, 24 of the string is oriented at a non-zero, non-orthogonal angle $\alpha$ to the shooting axis 16.

In some instances, it may be desirable to attach a crossbow cocking device, such as a cocking rope, to the string 12 when the crossbow is drawn. Traditional string hooks can present difficulty in engaging the string 12 in a drawn condition, for example because the hooks tend to assume an orientation that is perpendicular to the segment of string 22, 24 being engaged.

Figure 2:
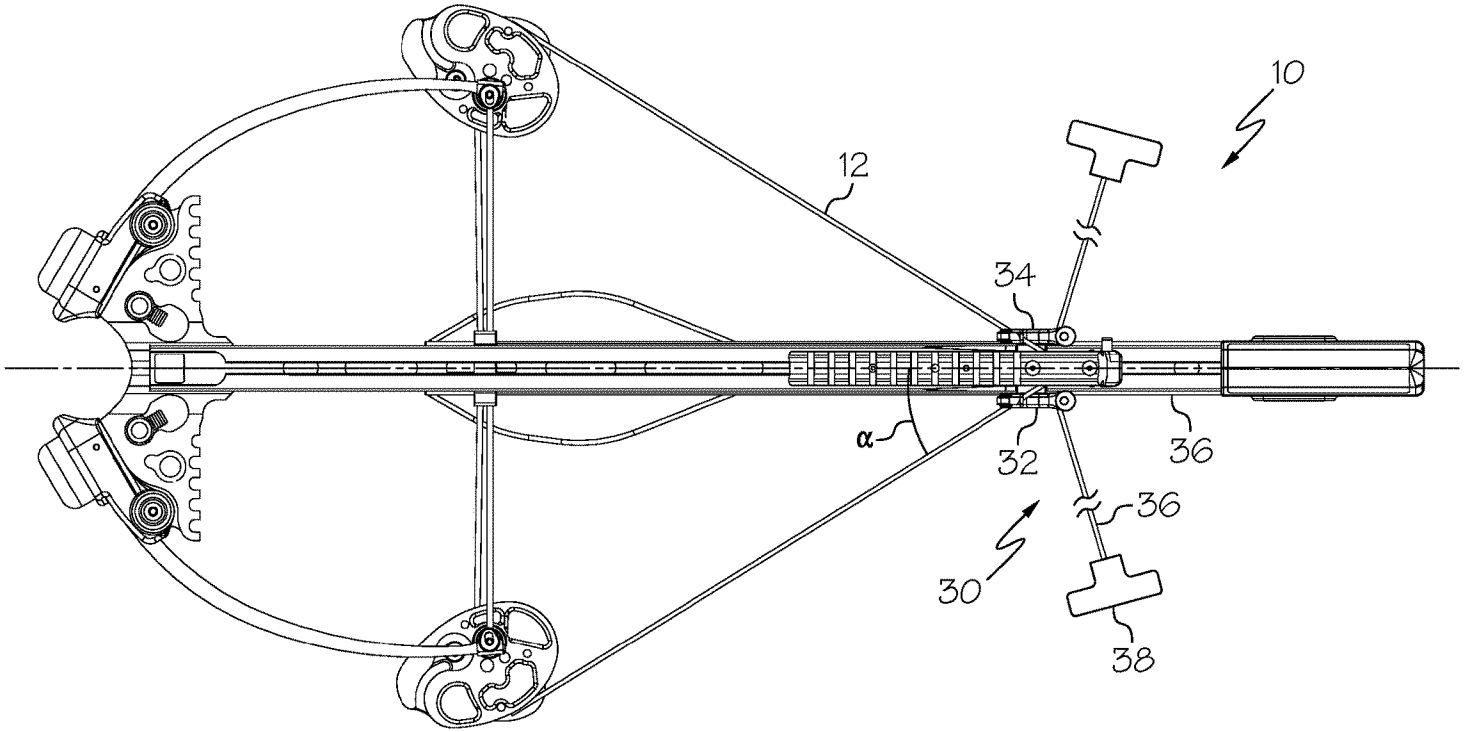
FIG. 2 shows an embodiment of a cocking device on a crossbow.

FIG. 2 shows a crossbow 10 and an embodiment of a rope cocking device 30. Desirably, a rope cocking device 30 comprises a segment of rope 36, cord or other suitable tension member, a first hook 32 and a second hook 34. In some embodiments, the rope cocking device 30 comprises handles 38. In some embodiments, a rope cocking device 30 comprises a crank mechanism, for example as disclosed in U.S. Pat. No. 9,341,434, the entire disclosure of which is hereby incorporated herein by reference. In some embodiments, a crank mechanism comprises a one-way mechanism such as a ratcheting mechanism, a roller clutch, a slip clutch, etc. In some embodiments, a crank mechanism comprises one or more spools arranged to spool the rope.

Figure 3:
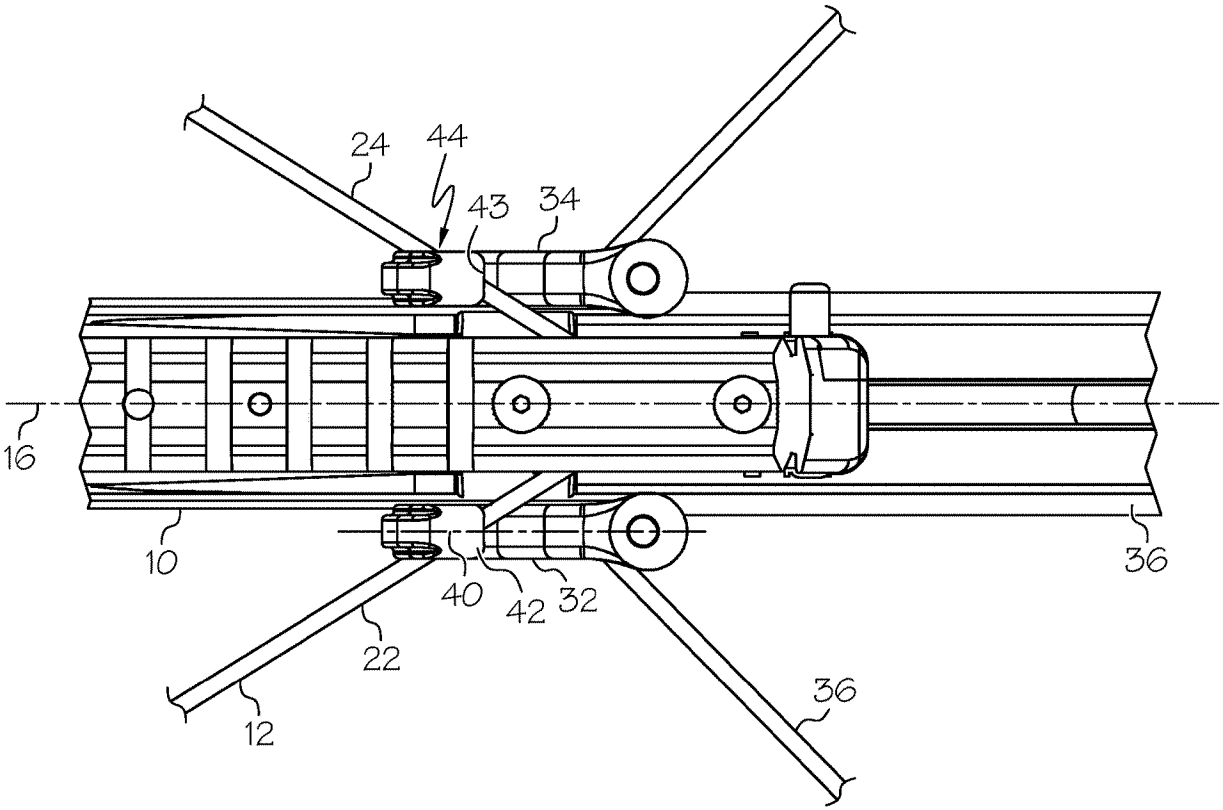
FIG. 3 shows a detail of an embodiment of hooks of a cocking device.

FIG. 3 shows embodiments of the hooks 32, 34 in greater detail. In some embodiments, each hook 32, 34 comprises a valley portion 44 or throat that is oriented at a non-zero, non-orthogonal angle to the shooting axis 16 when the hooks 32, 34 are properly oriented with respect to the crossbow 10. In some embodiments, a hook 32 comprises a body that defines a longitudinal axis 40, and the valley portion 44 of the hook 32 is oriented at a non-zero, non-orthogonal angle to the longitudinal axis 40.

In some embodiments, a shape of the first hook 32 comprises a mirror image of the shape of the second hook 34. Thus, the pair of hooks 32, 34 can be configured to properly engage the portions 22, 24 of string 12 on opposite sides of the shooting axis 16.

In some embodiments, a hook 32 comprises a flange portion 42. In some embodiments, an edge surface 43 of the flange portion 42 extends orthogonally to the longitudinal axis 40. In some embodiments, some or all of an edge surface 43 of the flange portion 42 can be oriented at a non-orthogonal angle to the longitudinal axis 40. In some embodiments, an edge surface 43 is shaped to match the shape profile of the valley portion 44 of the hook 32, 34.

Figure 4:
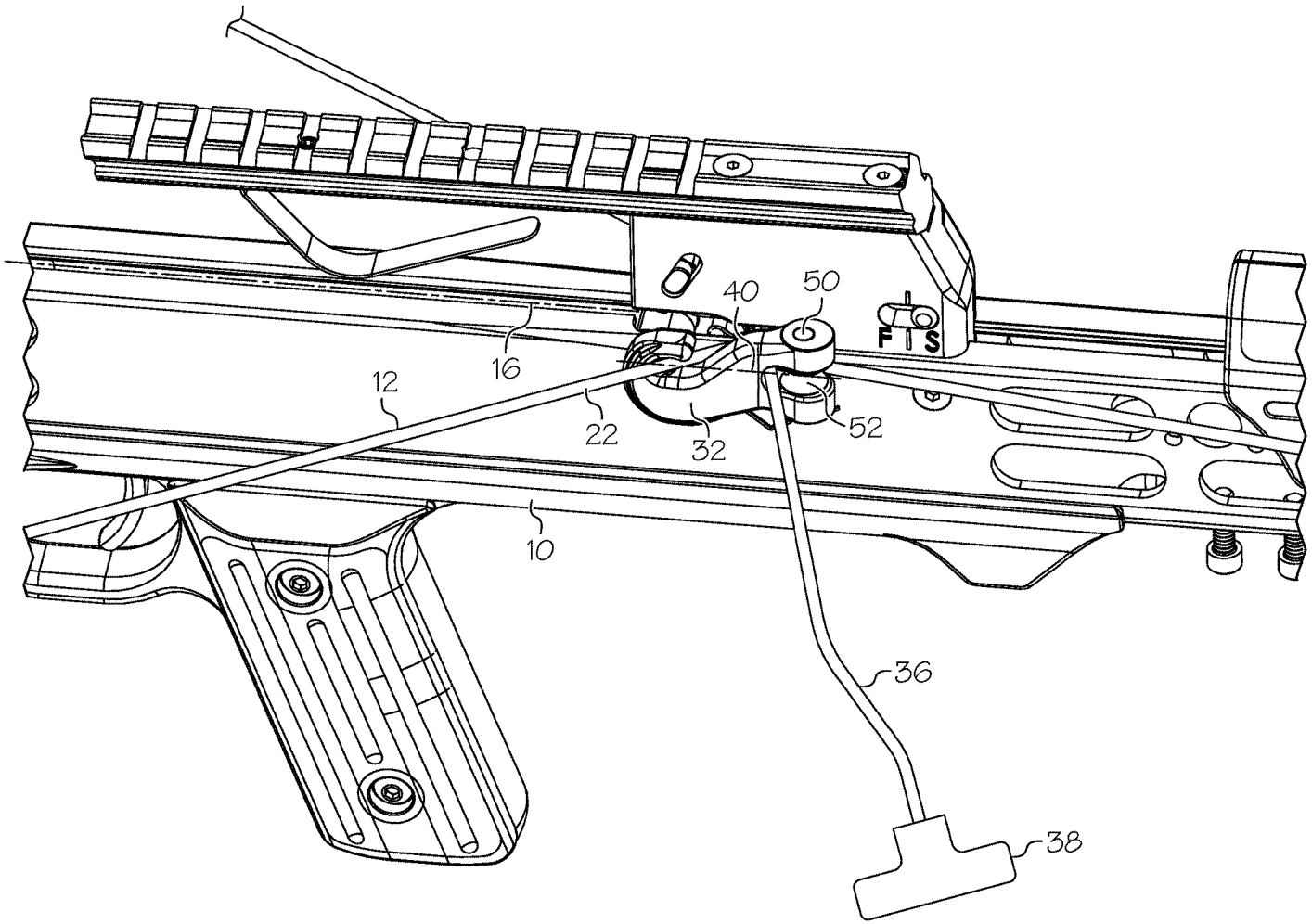
FIG. 4 shows an embodiment of a cocking device engaged to a crossbow.

FIG. 4 shows another view of a hook 32 engaging the string 12. In some embodiments, a hook 32 comprises a shaft 50 and a pulley 52 that rotates with respect to the hook 32 body. In some embodiments, a hook 32 can be engaged to the string 12 wherein the hook longitudinal axis 40 is parallel to the shooting axis 16 and the string 12 contacts a portion of the hook valley 44, which is oriented at non-orthogonal angle to the hook longitudinal axis 40.

Figure 5:
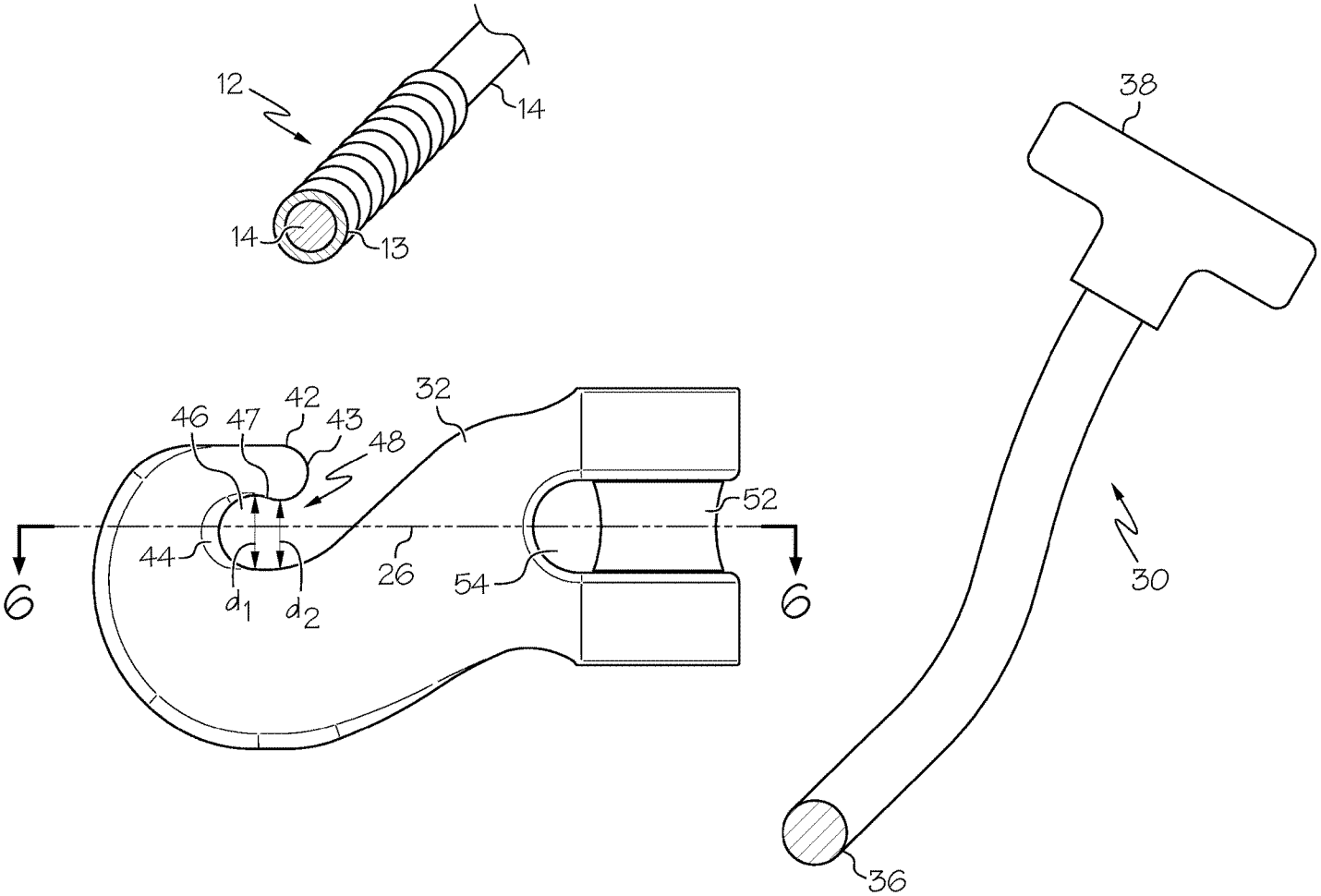
FIG. 5 shows an embodiment of a hook, a portion of a rope and a portion of a crossbow string.

FIG. 5 shows a side view of an embodiment of a hook 32. The hook 32 body defines a valley 44 and a flange 42. Desirably, the valley 44 surface comprises a portion oriented at a non-perpendicular angle to a longitudinal axis of the hook 32 body. In some embodiments, the valley 44 surface further comprises another portion that is oriented perpendicular to the longitudinal axis of the hook 32 body.

In some embodiments, one or more hooks 32 are arranged to engage a rope 36 such that the hook 32 will maintain its position on the rope 36 absent an application of outside force. Any suitable method can be used to engage the rope 36 and the hook 32. In some embodiments, the hook 32 and rope 36 are frictionally engaged with one another via the relative sizing of components. In some embodiments, the hook 32 and rope 36 are configured for an interference fit.

In some embodiments, a hook 32 defines a rope cavity 54 and the rope 36 extends through the rope cavity 54. In some embodiments, the cavity is at least partially defined by a pulley 52. In FIG. 5, a cavity 54 is shown unoccupied for clarity, but a cross-section of a rope 36 is also shown. In some embodiments, a rope 36 defines a distance across the rope 36 when the rope is in a nominal/unstressed condition, for example a nominal diameter.

In some embodiments, the hook(s) 32 are arranged to frictionally engage the rope 36 to retain their position on the rope 36. In some embodiments, a hook 32 will not move along a length of the rope 36 absent an application of external force. For example, a force of gravity will not cause the hook 32 to move on the rope 36, and the rope 36 can be positioned to extend vertically and the hook 32 will hold its place on the rope due to engagement between the hook 32 and rope 36. In some embodiments, an application of external force is required to move a hook 32 along a length of the rope 36.

In some embodiments, a distance across the rope cavity 54 is less than the nominal distance across the rope 36, which causes the cavity to frictionally engage the rope 36. In some embodiments, the force of gravity alone will not move the hook 32 with respect to the rope 36. Desirably, the hook 32 can be moved with respect to the rope 36 by the application of an external force that overcomes the engagement between the hook 32 and rope 36.

In some embodiments, the rope cavity 54 is aligned with the string cavity 46 such that a reference line 26 passes through a central portion of the rope cavity 54 and a central portion of the string cavity 46. In some embodiments, the rope cavity 54 can be offset from the location of the valley 44. For example, in some embodiments, a reference line 26 passes through a central portion of the string cavity 46, but the reference line does not pass through a central portion of the rope cavity 54. In some embodiments, a central portion of the rope cavity 54 is offset from the reference line 26 in a direction lateral to the reference line 26. In some embodiments, if the reference line 26 extends horizontally, the rope cavity 54 can be offset in a vertical direction. In some embodiments, the cavity 54 can be positioned lower than the valley 44. In some embodiments, the cavity 54 can be positioned higher than the valley 44.

Desirably, the hook 32 comprises a string cavity 46, and the string 12 of a crossbow 10 can be oriented in the string cavity 46 when the hook 32 is engaging the string 12. In some embodiments, the string cavity 46 is at least partially defined by the valley 44.

In some embodiments, an opening 48 to the string cavity 46 is defined. In some embodiments, the opening 48 is smaller in at least one dimension than a dimension of the string cavity 46. For example, in some embodiments, a distance $d_1$ across the string cavity 46 is greater than a distance $d_2$ across the opening 48. As shown in FIG. 5, distance $d_1$ comprises a height of the string cavity 46, and distance $d_2$ comprises a height of the opening 48.

In some embodiments, the flange 42 of the hook 32 comprises a protrusion 47, and the opening 48 is at least partially defined by the protrusion 47.

In some embodiments, the opening 48 is sized to have an interference fit with a crossbow string 12, providing resistance as the string 12 traverses the opening 48. Thus, a string 12 oriented in the string cavity 46 will tend to remain in the string cavity 46 unless an external force is applied to remove the hook 32 from the string 12. This can prevent the hook(s) 32 from falling off the string 12.

In some embodiments, a string 12 defines a distance across the string 12 such as a diameter. In some embodiments, a distance across the string cavity 46 equal to or slightly is less than the distance across the string 12, which causes the string cavity 46 to frictionally engage the string 12. In some embodiments, the force of gravity alone will not move the hook 32 with respect to the string 12. Desirably, the hook 32 can be moved with respect to the string 12 by the application of an external force that overcomes the engagement between the string cavity 46 and string 12.

In some embodiments, a distance $d_2$ across the opening 48 to the string cavity 46 is less than a diameter of a string 12.

In some embodiments, a string 12 comprises a base portion 14 and a serving 13. In some embodiments, the distances and diameters discussed with respect to a string 12 exclude a serving 13. In some embodiments, the distances and diameters discussed with respect to a string 12 include a serving 13.

Figure 6:
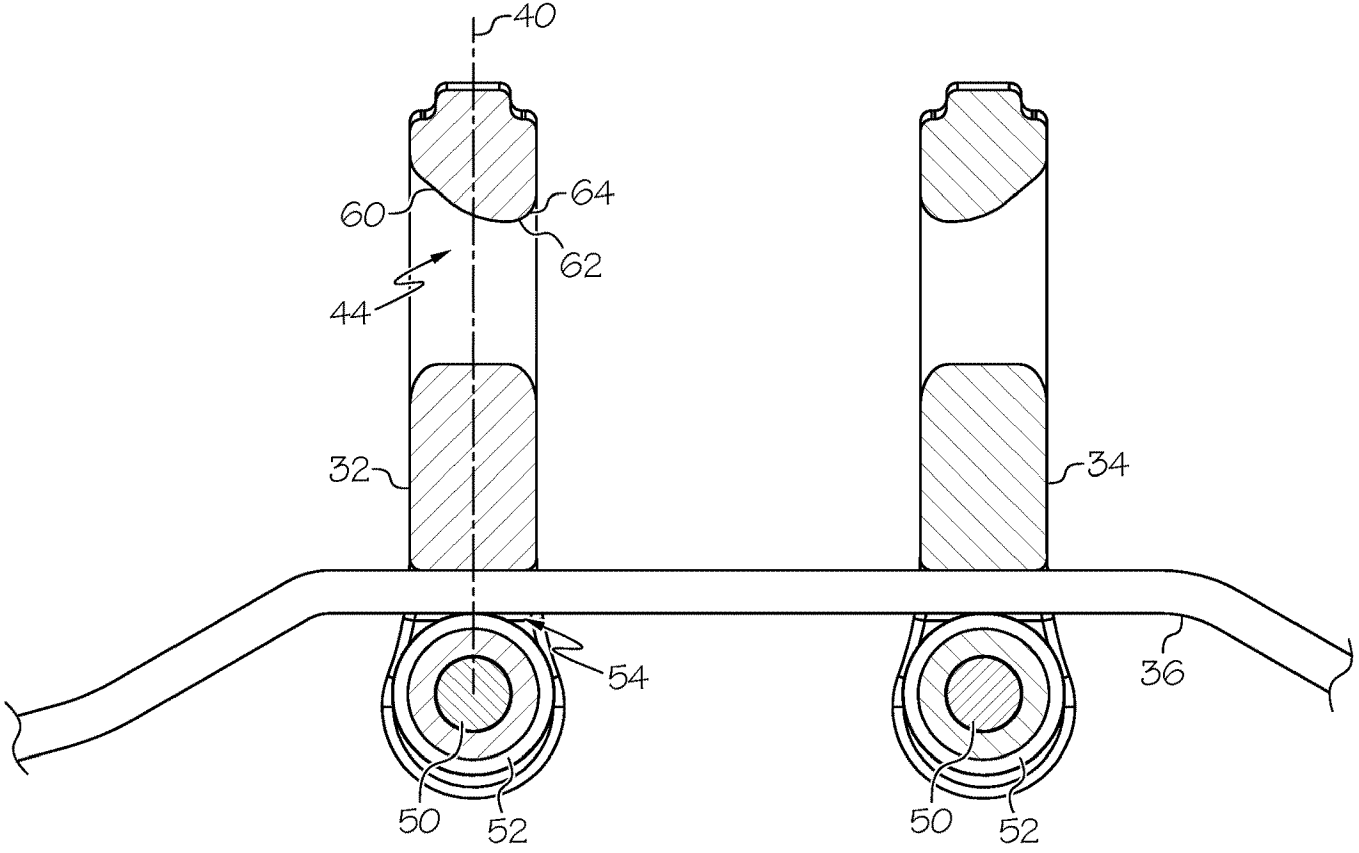
FIG. 6 shows a cross-sectional view of embodiments of hooks.

FIG. 6 shows a cross-sectional view of a hook 32 taken along line 6-6 in FIG. 5. A second hook 34 is also shown.

In some embodiments, the valley 44 portion of a hook 32 comprises a first portion 60 that is oriented at a non-perpendicular angle to a longitudinal axis 40 of the hook 32. In some embodiments, the valley 44 portion comprises a second portion 62 that is oriented perpendicular to the longitudinal axis 40. In some embodiments, the valley 44 portion comprises a third portion 64 that is oriented at a non-perpendicular angle to a longitudinal axis 40 and has an opposite orientation from the first portion 60. For example, the first portion 60 and third portion 64 can diverge as the valley 44 is traversed in a direction away from the shaft 50. In some embodiments, one or more of the valley portions 60, 62, 64 can be straight. In some embodiments, one or more of the valley portions 60, 62, 64 define curvature along their length. In some embodiments, the valley 44 can comprise at least one straight portion and at least one portion that is curved along its length.

In some embodiments, a surface of the valley 44 is arcuate. In some embodiments, a surface of the valley 44 defines an arc having a constant radius. In some embodiments, a surface of the valley 44 defines an arc having a variable degree of curvature. In some embodiments, a surface of the valley 44 defines an arc having a parabolic shape.

In some embodiments, a surface of the valley 44 is oriented at an angle to a longitudinal axis 40 of the hook 32. In some embodiments, the surface of the valley 44 is oriented at an angle between 20 degrees and 70 degrees to the longitudinal axis 40. In some embodiments, the angle is between 40 degrees to 60 degrees to the longitudinal axis 40.

In some embodiments, the shape of the second hook 34 comprises a mirror image of the first hook 32.

Figure 7:
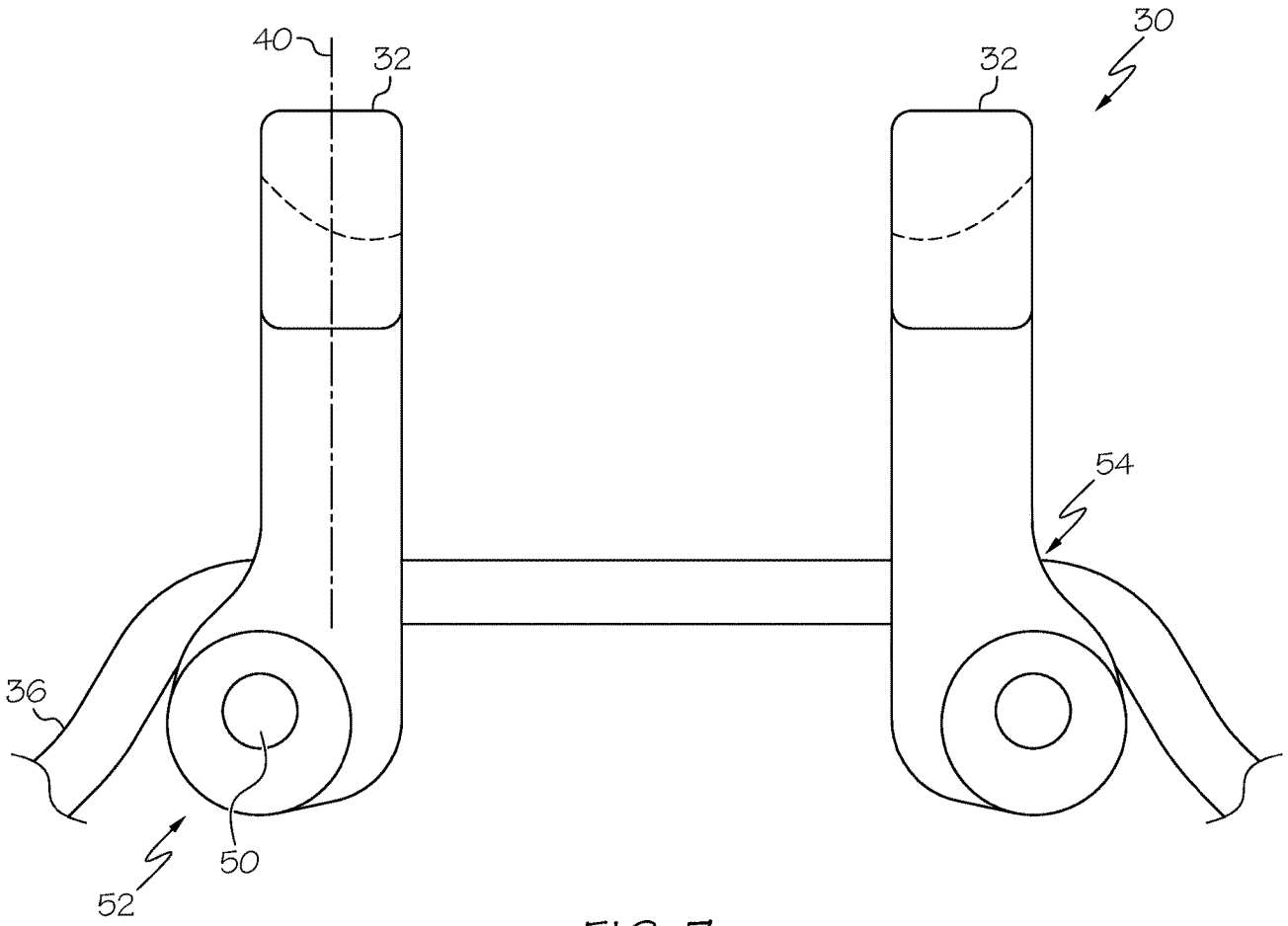
FIG. 7 shows further embodiments of hooks.

FIG. 7 shows another embodiment of a rope cocking device 30 having alternative hooks 32, 34. In some embodiments, the shaft 50 of a hook 32 is offset from the longitudinal axis 40 of the hook 32. The offset will change the interaction of forces between the hooks 32, 34 and crossbow, and can reduce the friction between the hooks 32, 34 and the crossbow as the rope cocking device 30 is used. In some embodiments, a distance between the shafts 50 of the two hooks 32, 34 is greater than a distance between the longitudinal axes 40 of the hooks 32, 34. In some other embodiments (not illustrated), a distance between the shafts 50 of the two hooks 32, 34 is less than a distance between the longitudinal axes 40 of the hooks 32, 34.

The above disclosure is intended to be illustrative and not exhaustive. This description will suggest many variations and alternatives to one of ordinary skill in this field of art. All these alternatives and variations are intended to be included within the scope of eventual claims where the term "comprising" means "including, but not limited to." Those familiar with the art may recognize other equivalents to the specific embodiments described herein which equivalents are also intended to be encompassed by the eventual claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

Those skilled in the art may recognize other equivalents to the specific embodiment described herein which equivalents are intended to be encompassed by the claims attached hereto.

The invention claimed is:

1. A crossbow cocking device comprising:

a rope;

a hook engaged with the rope, the hook comprising a rope cavity, the rope extending through the rope cavity, the hook defining a longitudinal axis, the hook comprising a valley, a surface of the valley oriented at a non-orthogonal angle to the longitudinal axis;

wherein a distance across the rope cavity is less than a nominal diameter of the rope.

2. The crossbow cocking device of claim 1, the angle being between 20 degrees and 70 degrees.

3. The crossbow cocking device of claim 1, comprising a second hook engaged with the rope, the second hook defining a second longitudinal axis, the second hook comprising a second valley, a surface of the second valley oriented at a non-orthogonal angle to the second longitudinal axis.

4. The crossbow cocking device of claim 1, wherein the surface of the valley and the surface of the second valley have opposite orientations.

5. The crossbow cocking device of claim 1, comprising a first handle and a second handle.

6. The crossbow cocking device of claim 1, comprising a spool, the rope wound about the spool.

7. The crossbow cocking device of claim 6, comprising a one-way mechanism engaged with the spool.

8. The crossbow cocking device of claim 1, the hook defining a string cavity and an opening into the string cavity, wherein a distance across the opening is less than a parallel distance across the string cavity.

9. The crossbow cocking device of claim 8, comprising a second hook, wherein a shape of the second hook comprises a mirror image of a shape of the hook.

10. The crossbow cocking device of claim 8, wherein a crossbow comprises a string, and the distance across the opening is less than a diameter of the string.

11. A crossbow cocking device arranged to engage a crossbow string, the device comprising:

a rope;

a hook engaged with the rope, the hook comprising a rope cavity, the rope extending through the rope cavity, the hook comprising a string cavity and an opening into the string cavity, the string cavity arranged to receive the crossbow string, wherein a distance across the opening is less than a parallel distance across the string cavity and a distance across the rope cavity is less than a nominal diameter of the rope.

12. The crossbow cocking device of claim 11, wherein the distance across the opening is less than a diameter of the crossbow string.

13. The crossbow cocking device of claim 11, comprising a second hook engaged with the rope, the second hook comprising a second string cavity and a second opening into the second string cavity, the second string cavity arranged to receive the crossbow string, wherein a distance across the second opening is less than a parallel distance across the second string cavity.

14. The crossbow cocking device of claim 11, the hook comprising a valley, a surface of the valley oriented at a non-orthogonal angle to a longitudinal axis of the hook.

15. The crossbow cocking device of claim 14, the angle being between 20 degrees and 70 degrees.

16. The crossbow cocking device of claim 14, comprising a second hook engaged with the rope, wherein a shape of the second hook comprises a mirror image of a shape of the hook.

17. A crossbow cocking device comprising:

a rope;

a hook engaged with the rope, the hook comprising a rope cavity, the rope extending through the rope cavity, the rope frictionally engaged with the rope cavity such that a force of gravity does not cause the hook to move along a length of the rope.

18. The crossbow cocking device of claim 17, wherein a distance across the rope cavity is less than a nominal diameter of the rope.

* * * * *